United States Patent [19]

Greenway

[11] 4,274,182

[45] Jun. 23, 1981

[54] APPARATUS FOR PRODUCING A SIMULATED STRIA FABRIC

[75] Inventor: John M. Greenway, Spartanburg, S.C.

[73] Assignee: Milliken Research Corporation, Spartanburg, S.C.

[21] Appl. No.: 922,874

[22] Filed: Jul. 10, 1978

[51] Int. Cl.[3] ..... D06C 23/04

[52] U.S. Cl. ..... 26/2 R; 28/160

[58] Field of Search ..... 26/2 R, 2 E, 27, 69 R; 28/160; 428/88

[56] References Cited

U.S. PATENT DOCUMENTS

| | | | |
|---|---|---|---|
| 1,069,588 | 8/1913 | Steiner | 26/2 R |
| 2,035,640 | 3/1936 | Dickie et al. . | |
| 2,170,968 | 8/1939 | Gentle | 26/2 R |
| 2,758,354 | 8/1956 | DecLoux | 26/2 R |
| 2,820,277 | 1/1958 | Forster . | |
| 3,052,947 | 9/1962 | Feild, Jr. . | |
| 3,641,635 | 2/1972 | Martin . | |
| 3,785,016 | 1/1974 | Hergert . | |
| 3,939,536 | 2/1976 | Ruppe | 26/2 R |

FOREIGN PATENT DOCUMENTS

| | | | |
|---|---|---|---|
| 768988 | 11/1971 | Belgium | 26/2 R |
| 653805 | 12/1962 | Canada | 28/160 |
| 1938966 | 4/1971 | Fed. Rep. of Germany | 26/69 R |
| 363094 | 4/1906 | France | 26/27 |

*Primary Examiner*—Robert Mackey

*Attorney, Agent, or Firm*—Earle R. Marden; H. William Petry

[57] ABSTRACT

An apparatus for producing velvet having an appearance similar to that of a woven velvet wherein slubbed yarns are used in the weft. The apparatus includes a non-contact heater for heating the pile of a fabric which is then pressed against a cool pattern roll where it is cooled to permanently set the pattern into the pile.

1 Claim, 5 Drawing Figures

APPARATUS FOR PRODUCING A SIMULATED STRIA FABRIC

When velvets are manufactured, unavoidable nonuniformities are often covered with deliberate imperfections. Slub yarns are often introduced into the weft of expensive woven velvets to create a "stria" effect which many consumers prefer for its elegant look. This technique cannot normally be used in knitted velvets because it is difficult for knitting machines to handle slubbed yarns. This invention concerns a method and apparatus for quickly and inexpensively introducing a "stria" effect into woven, tufted, or knitted velvets having thermoplastic piles. Basically, the stria effect is introduced by heating the pile of the fabric with a radiant heater and then pressing the pile against a cool, multi-bladed pattern member and cooling the fabric while the pile is in contact with the pattern member thereby setting the "stria" effect into the pattern. This method produces crisp, well defined lines which closely simulate the woven "stria" fabric. Further, the effect is surprisingly long-lasting and remains permanently set into the pile of the fabric.

Previously, velvets have been embossed by pressing a heated pattern member against the pile of the velvet and then cooling the velvet after the pattern member has been removed. The effect produced when the prior art method is used with a pattern roll having thin blades is not as crisp and well defined as that produced by the method of the present invention. It is thought that this difference may be due to the limited thermal conductivity of the pile which makes it difficult to heat and crimp more than one layer of tufts with a thin heated blade.

The apparatus of the present invention includes; a means for advancing a pile fabric, a non-contact heater for heating the pile of the fabric without disturbing the lay of the fibers in the pile; a pattern roll which the pile fabric is wrapped partially around and means for cooling the fabric while it is in contact with the pattern roll. It is extremely advantageous to use radiant heat to heat the pile of the fabric since radiant heat does not move the fibers in the pile thus the pile lay is undisturbed. When forced convection heaters or contact heaters are used, the pile is inevitably disturbed. It is also of great advantage to wrap the fabric around a substantial portion of the pattern roll, since this makes it possible to cool the pile while it is in contact with the pattern. Preferably, the pattern roll will rotate at a speed which matches its peripheral speed to the speed of the fabric. Conveniently, the roll will be driven by the fabric and will have a plurality of slots and a plurality of blades disposed in each slot. Each blade will be a thin planar member wherein the edge which is in contact with the pile is curved so that the central portion of the blade projects further from the roll than the two ends of the blade. This curved shape produces an indentation which tapers toward the end closely simulating the appearance of an actual slub.

DESCRIPTION OF THE PREFERRED EMBODIMENT

Figure 1:
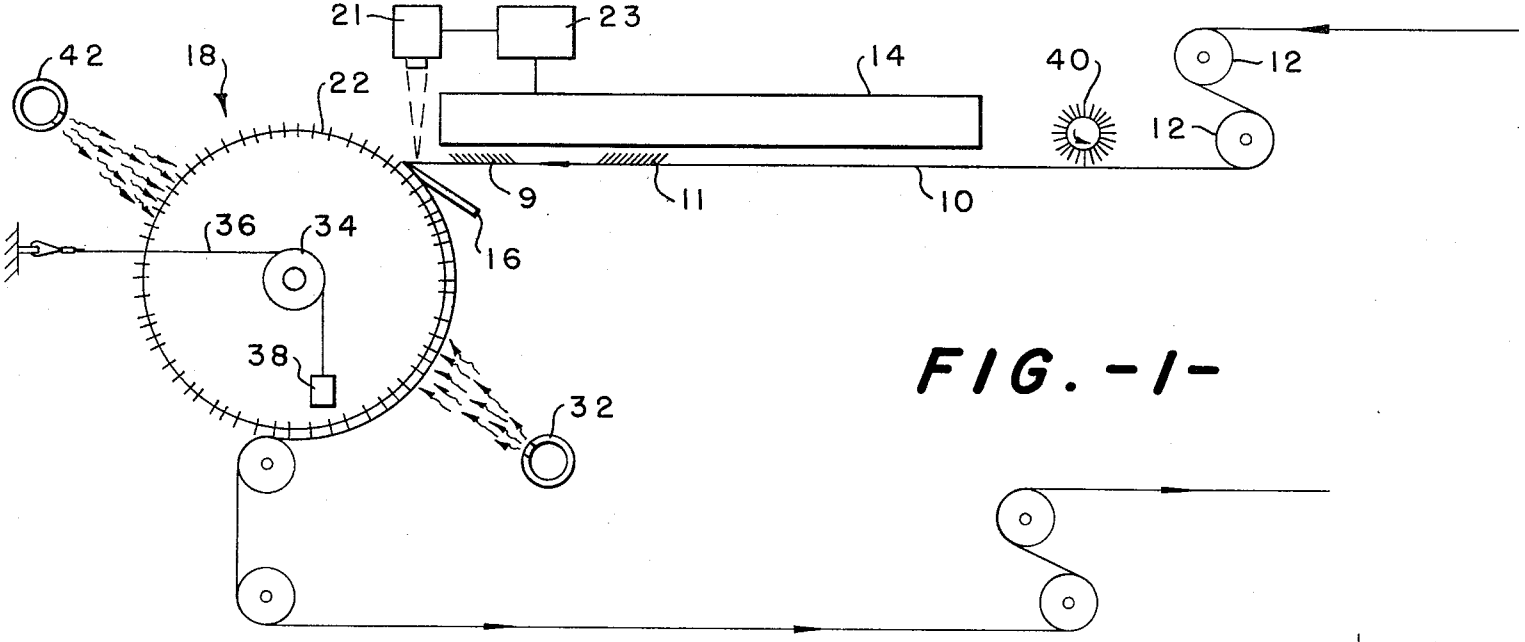
FIG. 1 is a schematic side elevation illustrating apparatus for producing a simulated stria fabric.

In FIG. 1, pile fabric 10 passes over rollers 12, then past infra red heater 14 which heats the pile of pile fabric 10 to a temperature above its glass transition temperature and softens the fibers in the pile without disturbing the orientation which has been previously imparted to the fibers in the pile.

After fabric 10 has been heated, it passes over arcuate support member 16 closely adjacent to stria pattern roll 18. Arcuate support member 16 is thin and preferably is closely adjacent to pattern roll 18.

Figure 2:
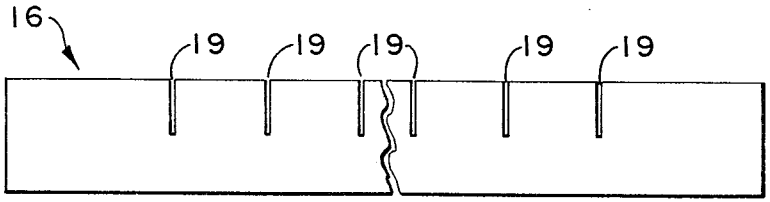
FIG. 2 illustrates the arcuate support member.

As shown in FIG. 2, arcuate support member 16 is segmented having a plurality of slits 19 formed in its central portion. This construction helps to stabilize the shape of arcuate support member 16 which would have a tendency to warp or buckle if unsegmented since its leading edge becomes hot because it is in contact with heated fabric 10. The portions of arcuate support member 16 which contact the selvages of fabric 10 are not segmented since the selvage might catch. It is very advantageous for support member 16 to be both closely adjacent to pattern roll 18 and substantially parallel to the periphery of pattern roll 18 so that heater 14 can be closely adjacent to pattern roll 18. In this manner, excessive cooling of fabric 10 between heater 14 and pattern roll 18 can be avoided, thus minimizing the temperature to which fabric 10 must be heated to allow proper patterning and reducing the danger of over-heating. To further minimize the danger of over-heating, non-contact temperature measuring means such as infra-red camera 21 may be used to measure the temperature of fabric 10 as it leaves heater 14. Advantageously, the output of infra-red camera 21 acting through controller 23 may be used to control heater 14.

Figure 3:
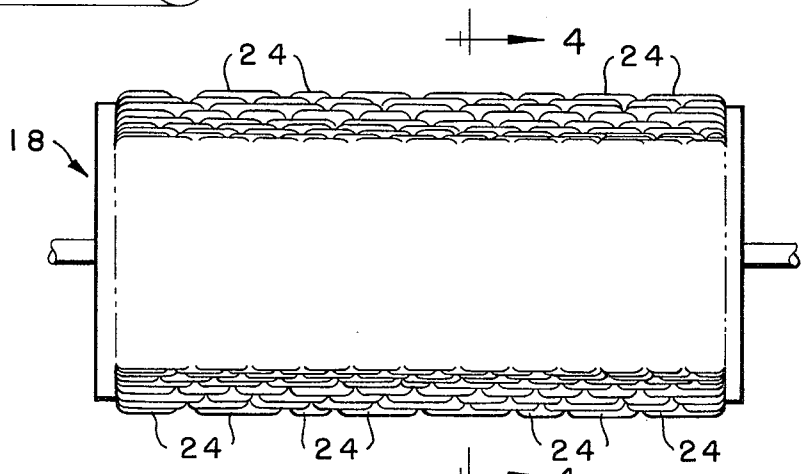
FIG. 3 illustrates the pattern roll for producing a simulated stria fabric.
Figure 4:
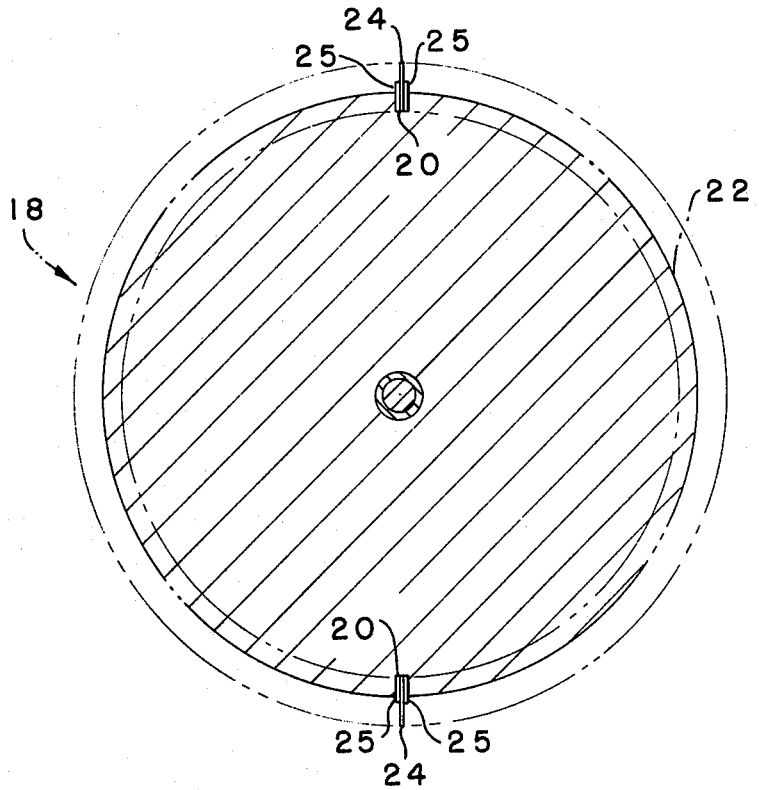
FIG. 4 is a sectional view taken along section 4—4 in FIG. 3.
Figure 5:
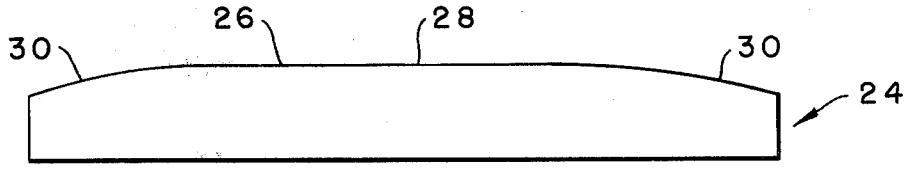
FIG. 5 illustrates a blade for use on the pattern roll.

As shown in FIGS. 3 and 4, pattern roll 18 is substantially cylindrical and has a plurality of slots 20 cut into its outer surface 22. A plurality of blades 24 of varying lengths are mounted on pattern roll between shims 25 within each slot 20. As shown in FIG. 5, each blade 24 is a substantially planar member having an outer edge 26 wherein center portion 28 is essentially a straight line parallel to the axis of rotation of pattern roll 18 while end portions 30 of outer edge 26 curve inward toward the center of pattern roll 18. Blades 24 are shaped in this fashion to produce indentations which taper at the ends and therefore closely simulate the appearance of slubs in woven velvets.

While fabric 10 is wrapped around pattern roll 18, jet 32 exhausts cool air against the back of fabric 10 and thereby cools the pile of the fabric 10 to a temperature below its glass transition temperature while it is still in contact with pattern roll 18. If low production speeds can be tolerated, the fabric may be allowed to cool by natural convection only.

Since radiant heaters are used to heat the pile of fabric 10, it is possible to easily obtain a variety of effects which are not so easily obtained using the prior art methods. In particular, it is possible to conduct pile fabric 10 through the device with the pile leaning in any desired direction. For example, in FIG. 1, the pile indicated at 9 is leaning in the direction of advance of the fabric while the pile indicated at 11 is leaning in the direction opposite to the direction of travel of the fabric. For convenience, it is stated that the pile indicated at 9 is going through the machine in the "rough" direction while the pile indicated at 11 is going through the machine in the "smooth" direction.

When the fabric is passed through the machine in the smooth direction and the multi-bladed pattern roll is allowed to rotate freely, the effect produced closely simulates the appearance produced by actual slubs but if the fabric is passed through the machine in the rough direction, the effect, while pleasing, does not simulate the appearance produced by slubs. Consequently, it is not in demand by consumers. Conveniently, brush 40 may be included to impart the desired orientation to the pile fabric 10 before it passes through radiant heater 14. Alternatively, the fabric may be brushed beforehand.

To produce the illusion of larger slubs, pattern roll 18 may be retarded so that the peripheral velocity of blades 24 is slightly less than the speed of fabric 10. FIG. 1 illustrates one convenient method of braking pattern roll 18 wherein sheave 34 is attached to pattern roll 18 and line 36 having weight 38 attached is passed over sheave 34 to retard roll 18.

To allow the device to be operated at higher speeds, pattern roll 18 may be cooled by jet 42 which exhausts air against the portion of pattern roll 18 which is not in contact with fabric 10.

As my invention, I claim:

1. Apparatus for patterning fabric having a thermoplastic pile, including: heater means for heating the pile of said pile fabric to above its glass transition temperature without disturbing the orientation of fibers in the pile of said fabric; cool pattern roll means arund which said pile fabric is wrapped, the pile of said pile fabric contacting said cool pattern roll means; means for cooling the pile of said pile fabric to a temperature which is below the glass transition temperature of said pile fabric while the pile is in contact with said cool pattern roll means; and means for advancing said pile fabric past said heater means and around said pattern roll means, said apparatus including an arcuate support means over which said fabric may be passed closely adjacent and substantially parallel to the periphery of said pattern roll, said arcuate support means including an arcuate support member having a plurality of slits formed therein to stabilize the shape of said arcuate support means against warping.

* * * * *